United States Patent [19]

Theurer et al.

[11] 4,324,186

[45] Apr. 13, 1982

[54] CONVERTIBLE RAIL-HIGHWAY LATERAL TRACK SET OFF APPARATUS

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 84,649

[22] Filed: Oct. 15, 1979

[30] Foreign Application Priority Data

Dec. 11, 1978 [AT] Austria ..... 8811/78

[51] Int. Cl.[3] ..... B61B 12/00; B61D 15/00; B61F 13/00

[52] U.S. Cl. ..... 105/177; 104/1 R; 104/264; 105/215 C

[58] Field of Search ..... 105/177, 29 R, 215 C; 104/1 R, 264

[56] References Cited

U.S. PATENT DOCUMENTS

| | | | |
|---|---|---|---|
| 1,989,654 | 1/1935 | Landis et al. | 105/177 |
| 2,009,113 | 7/1935 | Landis et al. | 105/177 |
| 2,117,077 | 5/1938 | Bernard | 105/177 |
| 3,221,668 | 12/1965 | Munck | 105/29 R |
| 3,385,230 | 5/1968 | Kershaw et al. | 105/177 |
| 3,412,691 | 11/1968 | Mueller et al. | 105/177 |
| 3,540,153 | 11/1970 | Aoki | 105/29 R X |

FOREIGN PATENT DOCUMENTS

| | | | |
|---|---|---|---|
| 323258 | 9/1957 | Switzerland | 105/177 |
| 813450 | 5/1959 | United Kingdom | 105/177 |

*Primary Examiner*—Joseph F. Peters, Jr.
*Assistant Examiner*—Howard Beltran
*Attorney, Agent, or Firm*—Kurt Kelman

[57] ABSTRACT

A railroad set-off apparatus includes vertically movable running gears and an auxiliary track extending transversely to the railway carriage on which it is mounted, the auxiliary track having two rails for the running gears, each of the auxiliary track rails consisting of at least two rail sections pivotally connected to each other, one of the rail sections of each auxiliary track rail being pivotal into a vertical position, struts interconnecting the two rails, power drives for pivoting the one rail section and a support for at least one end of the rails. A rack-and-pinion drive is provided for transversely moving the carriage on the running gears along the auxiliary track.

4 Claims, 5 Drawing Figures

Fig. 1
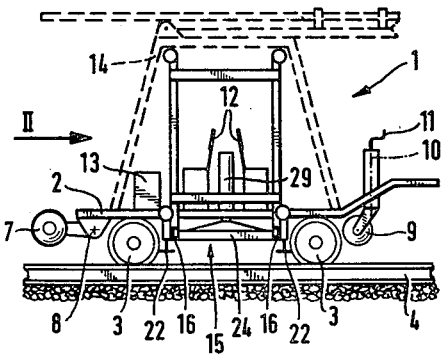
Fig. 2
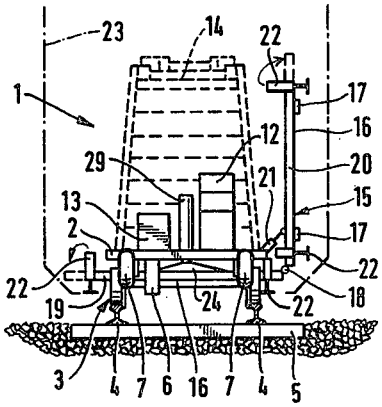
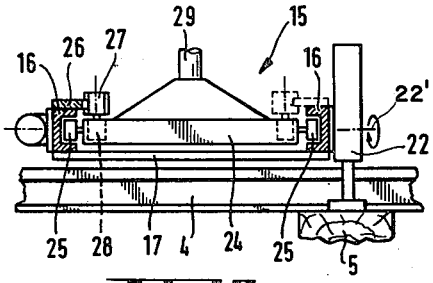
Fig. 3
Fig. 4
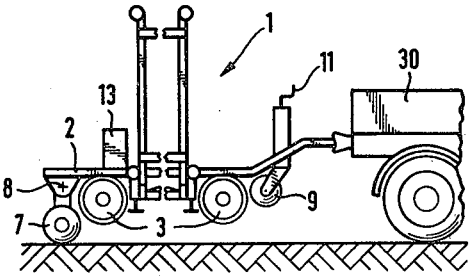
Fig. 5
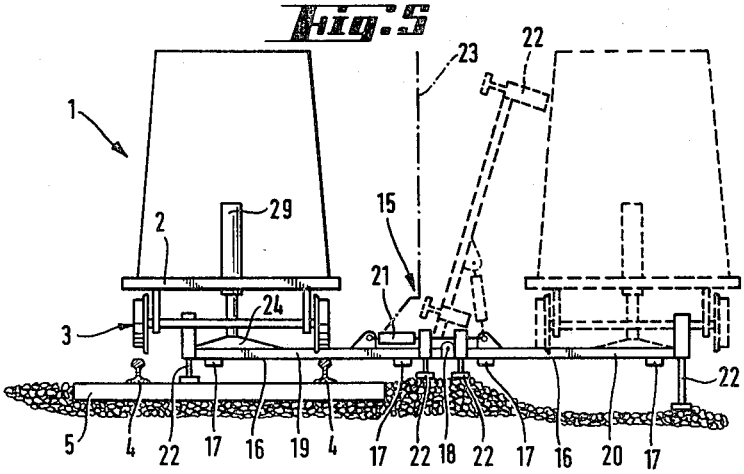

CONVERTIBLE RAIL-HIGHWAY LATERAL TRACK SET OFF APPARATUS

The present invention relates to improvements in a railway carriage, particularly a light work car for track maintenance, repair or transportation, comprising a set-off apparatus for moving the carriage transversely off the track.

Swiss Pat. No. 323,258, published Sept. 14, 1957, discloses a set-off apparatus for a mobile track tamper, which includes an auxiliary track extending transversely to the tamper carriage and having two rails for running gears, each auxiliary track rail consisting of two rail sections one of which is retained by hooks and bolts in a rest position on the running gears at the front and rear ends of the carriage while the other rail section is pivotal into a vertical position in which it may be retained by means of a rail engaging means on the superstructure of the carriage. The tamper carriage may be moved transversely off the track by lowering the vertically movable running gears until the rail sections retained thereon rest on the track. The gauge of the lowered auxiliary track rail sections is maintained by fixing them to the track by hooks, bolts and the like and the pivotal auxiliary track rail sections are then manually lowered into horizontal alignment with the auxiliary track rail sections fixed on the track and are positioned on separate supports laterally offset from the track. The hooks retaining the auxiliary track rail sections on the running gears are then disengaged and the carriage is raised sufficiently by the hydraulic motors used to lower the running gears to lift the flanged wheels of the undercarriages of the mobile tamper above the track plane. The carriage is now able to move transversely on the running gears along the auxiliary track and the main track is available for the passage of a train by pivoting the auxiliary track rail sections on the track into a vertical position.

This set-off apparatus requires a great number of manual operations and, therefore, a relatively long time, particularly in the case of small carriages operated by a single person. In addition, the positioning of the auxiliary track rail sections on the lateral supports requires survey measurements to make certain that the gauge is maintained therebetween, which requires more time. Since no drive is provided for the transverse movement of the carriage, the carriage must be moved manually or by winches.

Another type of off-set apparatus is disclosed in British Pat. No. 813,450, published May 13, 1959. According to this patent, carriage-supporting girders and supports therefor are loosely carried on the carriage and, when needed, the girders are laid transversely to the track and positioned on the supports erected laterally of the track. Vertically adjustable auxiliary running gears are mounted on the sides of the carriage and may be lowered into engagement with the girders while the carriage is sufficiently raised to disengage its flanged wheels from the track, whereupon the drives for the running gears are operated to move the carriage transversely along the girders. The girders are then removed from the track to permit a train to pass. This set-off apparatus operates relatively quickly.

The railroad set-off apparatus of U.S. Pat. No. 3,385,230, dated May 28, 1968, includes an auxiliary trackway consisting of three sections which are pivoted to each other, a first trackway section being supportable on the track rails on which the carriage runs, the following trackway section being supportable on an outwardly projecting bracket which carries a rail hook element adapted to hook the lower portion of the adjacent rail, and the third trackway section being supportable by a support wheel on the embankment. The second and third trackway sections form a descending trackway on which the carriage is transversely moved on sprocket wheels engaging chains running along the auxiliary trackways. This set-off apparatus has considerable disadvantages. Thus, the sprocket drive is subjected not only to the drive forces transmitted to the sprocket wheels but also to the weight of the carriage moving down the trackway, which causes rapid wear of the sprocket drive. This is aggravated by the fact that the sprocket chains are exposed to dirt and the weather. Furthermore, relatively powerful drives are required for the sprocket wheels because the off-set carriage must be moved back on the track over a rather steeply graded trackway. Furthermore, no means is provided for maintaining the gauge of the trackway rails so that the sprocket wheels and chains are subjected additionally to lateral strains.

It should be noted that the above-described set-off apparatus embodiments are all designed for heavy vehicles, such as track tampers, track liners and like track working machines. Track maintenance work requiring the use of such mobile machines is usually quite extensive, because their use would otherwise be uneconomical, and the work normally extends over a considerable period of time. Such work is carefully planned and if it is not possible to halt train traffic completely along a track section subjected to rehabilitation work, trains are usually moved over adjacent tracks or other measures are taken to provide long intervals between trains. Therefore, set-off apparatus on such mobile machines is used quite rarely so that the time required for assembly and disassembly is rather insignificant in relation to the total maintenance work time even if the off-set apparatus is quite cumbersome.

A totally different situation prevails in the use of light carriages used for such maintenance or repair work on railroads as signal or safety devices, guide rails and power lines, or the transport of work crews with ladders and tools. Since such work usually is not extensive, it does not justify re-scheduling of train traffic. Therefore, this type of work often encounters frequent passage of trains and the carriages must be quite frequently set off the track to permit such passage. Therefore, it becomes essential to reduce the time for assembly and disassembly of the set-off apparatus to a minimum to accommodate the work to the short intervals between trains, and it becomes a decisive consideration in determining whether sufficient work time is available between trains to make the use of the carriage economical for the contemplated work.

In addition to the time element in setting up and dismantling the set-off apparatus, another consideration is the limited availability of space on small work cars, which makes it uneconomical to carry along girders and supports, such as proposed in the above-mentioned British patent. This would substantially reduce the space available for tools or personnel to be transported by the small car.

It is, therefore, the primary object of this invention to provide a railway carriage, particularly of the indicated light-car type, with a set-off apparatus which enables even a single operator to move the carriage speedily transversely off and on track, which apparatus is simple, robust and efficient. Furthermore, the set-off apparatus of the invention requires little exertion by the operator, nor is the operator subjected to any danger in setting up the auxiliary track.

The above and other objects are accomplished according to the invention with a set-off apparatus which includes vertically movable running gears, and an auxiliary track extending transversely to the carriage and having two rails for the running gears, each of the auxiliary track rails consisting of at least two rail sections pivotally connected to each other, one of the rail sections of each auxiliary track rail being pivotal into a vertical position, struts interconnecting the two rails, power drive means for pivoting the one rail section, and a support for at least one end of the rails. The apparatus also includes a drive for transversely moving the carriage on the running gears along the auxiliary track, the drive comprising force-transmitting means including an element on the carriage engaging an element on the auxiliary track.

Providing struts interconnecting the two auxiliary track rails and a support for at least one end of the rails produces in an unexpectedly simple manner an off-set apparatus with a stable set-up section whose other section may be rapidly pivoted from a substantially vertical rest position into a horizontal operating position. The interconnecting struts maintain the auxiliary track at gauge throughout its length and no time-consuming fixing and measuring is required, nor is there any need for special supports to be emplaced, causing an additional loss of time. Since the power drive is provided for pivoting the auxiliary track section between its rest and operating positions, further time and effort is saved. In addition, the set-off operation is additionally facilitated by the drive for transversely moving the carriage, relatively little power being required for this drive since the auxiliary track extends substantially horizontally.

The above and other objects, advantages and features of the present invention will become more apparent from the following detailed description of a now preferred embodiment thereof, taken in conjunction with the accompanying schematic drawing wherein FIG. 1 is a side elevational view of a track-bound carriage with a set-off apparatus according to this invention, the apparatus being shown in its rest position;

FIG. 2 is a front view of the carriage in the direction of arrow II in FIG. 1;

FIG. 3 is a side elevational view illustrating details of the set-off apparatus on an enlarged scale;

FIG. 4 shows the carriage of FIG. 1 when transported over a road; and

FIG. 5 shows the carriage of FIGS. 1 and 2 diagrammatically in two characteristic positions, one indicated in full lines and the other one in broken lines.

Referring now to the drawing, there is shown railway carriage 1 comprising set-off apparatus 15 for moving the carriage transversely off the track consisting of rails 4 fastened to ties 5. The carriage has frame 2 supported on undercarriages 3 whose flanged wheels run on the track rails. The carriage is self-propelled, drive 6 being connected to one of the undercarriages for moving the carriage along the track.

To enable carriage 1 to be moved off-track, a pair of wheels 7 with pneumatic tires are mounted at one end of carriage frame 2. The wheels may be pivoted between a rest or retracted position and an operating position about horizontal axis 8 extending transversely to the carriage, the retracted position being shown in FIGS. 1 and 2 while the operating position of wheels 7 is shown in FIG. 4. The wheels may be locked in each position. Another auxiliary wheel 9 with a pneumatic tire is mounted at the opposite end of carriage frame 2 centrally between the two sides of the carriage frame. Wheel 9 is pivotal about vertical axis 10 for guidance of the carriage in a desired direction when the wheel is moved from its retracted position into an operating position by turning crank 11 which is provided for vertical adjustment of the wheel in relation to carriage frame 2.

Two operator's seats 12 and power plant 13 for drive 6 and the hydraulic motors are mounted on carriage frame 2. As indicated in broken lines in FIGS. 1 and 2, collapsible ladder 14 may be carried on the carriage frame to enable the carriage to be used for maintenance or repair work on overhead power lines, for example. Obviously, this type of work car may carry tools or equipment for any desired work to be done on or along the track.

Set-off apparatus 15 enables the carriage to be temporarily moved transversely off the track in either lateral direction, depending on the prevailing operating and topical conditions, to enable trains to pass the work site. This apparatus includes vertically movable auxiliary running gears 25 and an auxiliary track extending transversely to carriage 1. The auxiliary track has two rails 16 for the running gears. Each auxiliary track rail consists of two rail sections 19, 20 pivotally connected at 18 to each other, rail section 20 of each auxiliary track rail being pivotal into a vertical position, as shown in FIG. 2. Struts 17 interconnect rails 16 and power drive means illustrated as hydraulic motors 21 interconnect the rail sections for pivoting rail section 20. Supports 22 are arranged at each end of auxiliary track rails 16, as shown in FIGS. 2, 3 and 5. If desired, a single hydraulic pivoting motor may be provided in association with one of the auxiliary track rails but possible stresses will be avoided if each rail is equipped with its own motor and the two motors are operated in unison. In the illustrated embodiment, support jacks 22 are arranged on each rail section end for most effective support of the extended auxiliary track, hydraulic jacks being very useful to provide ready vertical adjustment of the supports. As shown in broken lines in FIG. 2, supports 22 are angularly adjustable on rail sections 19 and 20 into two positions about 90° apart (indicated by arcuate arrows) and suitable clamping or blocking means are provided for fixing the supports in each adjusted angular position. Since such means are entirely conventional, they are not shown in the schematic drawing figures so as to limit the illustration to the essential structures and not to obstruct the views thereof. In this manner, the supports can be repositioned so that they will not project beyond the lateral boundaries of operative track gauge 23 even if carriage 1 is relatively wide. FIG. 3 shows pivoting axis 22' about which supports 22 are angularly adjustable, the jack on the left side being shown in the rest position while the jack on the right side has been angularly adjusted about pivot 22' into the operating position.

Using vertically adjustable supports has the advantage that the auxiliary track may be properly supported in a horizontal position even if the topography is poor and hydraulic jacks are particularly useful for this purpose since they may be very rapidly adjusted.

As shown in FIG. 3, the auxiliary track rails according to a preferred feature of this invention are U-shaped and have two legs extending horizontally in an operating position of auxiliary track rails 16. The running gears are rollers 25 engaging the legs substantially without play and running in the U-shaped track rails. A carrier body shown as cradle 24 supports the rollers and power drive 29 illustrated as a hydraulic motor connects the cradle to carriage 1 for vertical adjustment of the cradle.

The preferred drive for transversely moving carriage 1 on running gears 25 along auxiliary track 16, 16 is illustrated as a rack-and-pinion drive, at least one of track rails 16 being equipped along its entire length with rack 26 meshing with pinion 27 journaled on cradle 24. The pinion is driven by hydraulic motor 28 connected thereto and rotatable in either direction. As shown in broken lines in FIG. 3, a like rack-and-pinion drive may be provided at the other auxiliary track rail. Since running gear rollers 25 are tightly engaged in the auxiliary track rails, they are vertically moved by motor 29 with cradle 24.

A rack-and-pinion drive provides a particularly robust and trouble-free force-transmitting drive assuring a lateral movement of the carriage under relatively low power more effectively than a mere frictional engagement of driving and driven drive elements. It also enables the auxiliary track to be moved laterally when the running gears are retracted. This makes it possible to do with only two relatively short auxiliary track rail sections which are pivotal in relation to each other since it is possible to move the pivots of the two rail sections into an operating position outside the effective track gauge 23 when set-off apparatus 15 is in the rest position so that the track gauge is free of encumbrance after the carriage has been transversely moved and one auxiliary track rail section has been pivoted into its vertical position.

Mounting running gear rollers 25 substantially without play between the legs of the U-shaped rails 16 makes it possible to move the rails and running gears together by motor 29, without requiring hooks or bolts for fixing the auxiliary track rails, all movements being effected simply and efficiently by hydraulic motors. Also, since the entire set-off apparatus is mounted on the carriage frame between its undercarriages, carriage 1 may be equipped with end couplings enabling it to be used as a standard car in a train and with auxiliary wheels with pneumatic tires for alternative movement over roads.

Such an alternative use is shown in FIG. 4. As illustrated in this figure, carriage 1 is coupled as a trailer to tractor 30 which moves the carriage over a road to a designated working site. In this transport position, wheels 7 are downwardly pivoted to engage the road surface and support the rear end of carriage 1 while undercarriages 3 are off the ground. The carriage may be removed from the track at a crossing, for example, very rapidly and simply. Motor 29 is operated to lower cradle 24 with auxiliary track rails 16 and further to raise the carriage sufficiently above the plane of the crossing that wheels 7 may be pivoted 90° from their rest or retracted position into the operating position. Crank 11 is then turned to lower auxiliary front wheel 9 until its pneumatic tire contacts the plane of the crossing. After cradle 24 and rails 16 are raised again by motor 29, carriage 1 may be pulled off the track, wheel 9 operating as a guide wheel enabling the carriage to be guided in any direction, due to its pivoting about axis 10. After the carriage is coupled to tractor 30, front wheel 9 is retracted again and the carriage is moved over the road like a single-axle trailer. When the carriage arrives at its destination, it may be moved onto the track in the same manner and in reverse order.

The operation of set-off apparatus 15 will be more fully explained in connection with FIG. 5.

Drive 6 is operated to move carriage 1 along the track to a working site. When it is desired to move the carriage temporarily off the track, motor 28 is actuated, in the raised position of the cradle, to operate rack-and-pinion drive 26, 27 and to move auxiliary track rails 16 so far to the side of the main track to which the carriage is to be moved that pivot 18 between rail sections 19 and 20 is positioned outside the lateral boundary of operative track gauge 23, as shown in full lines in FIG. 5. Motor 29 is then operated to lower cradle 24 and the auxiliary track carried thereby until jacks 22 engage the ballast bed or ground. Once the auxiliary track section 19 is supported, pivoting drive 21 is operated to pivot auxiliary track section 20 from its vertical rest position into its horizontal operating position. The various jacks 22 are then vertically adjusted until both auxiliary track sections are leveled in a horizontal plane. Motor 29 is then operated again until the wheels of undercarriages 3, 3 are above the running surfaces of main track rails 44, in which position carriage 1 can be moved transversely to the lateral position shown in broken lines by operation of rack-and-pinion drive 26, 27, 28. At this point, motor 21 is operated to pivot auxiliary track section 19, which projects into operative track gauge 23, into a vertical rest position, thus freeing the main track. After the train has passed over the main track, carriage 1 is returned thereto in the same manner in reversed order of steps.

Since supports 22 are provided at each end of auxiliary track sections 19 and 20, carriage 1 may be set off to either side of the main track in the identical manner, i.e. it may be moved to the left, as seen in FIG. 5, in the manner described hereinabove.

While the set-off apparatus has been described in connection with a relatively small work car, larger track-bound carriages of generally light construction may also be equipped with this apparatus, including crane carriages, work crew transportation cars, measuring bogies and various other types of track work cars. All such carriages desirably should be temporarily removable from a main track in a speedy and dependable manner.

What is claimed is:

1. A railway carriage having two undercarriages for running on a track and comprising a set-off apparatus for moving the carriage transversely off the track, the set-off apparatus including (a) a carrier body having auxiliary running gears, (b) a power drive means vertically movably mounting the carrier body on the carriage, (c) an auxiliary track extending transversely to the track, the auxiliary track having (1) two rails supporting the auxiliary running gears, each of the auxiliary track rails consisting of at least two rail sections pivotally connected to each other at adjoining ends, one of the rail sections of each auxiliary track rail being pivotal from an operating position flush with the other rail section into a vertical position, (2) struts interconnecting the two rails, (3) a hydraulic drive interconnecting the adjoining rail section ends for pivoting the one rail section, and (4) a support mounted on ends of each of the rails, and (5) a power actuated means vertically adjusting the support, and (d) a drive having respective parts interconnecting the carriage and the auxiliary track rails for transversely moving the carriage.

2. The track-bound carriage of claim 1, wherein the drive is a rack-and-pinion drive, one of the parts being a rack affixed to a respective one of the auxiliary track rails and the other part being a reversibly rotatable, power-driven pinion meshing with the rack.

3. The track-bound carriage of claim 1 or 2 further comprising means angularly adjusting the supports in relation to the rails over an acute angle in relation to the vertical.

4. The track-bound carriage of claim 1 or 2, wherein the auxiliary track rails are U-shaped and have two legs extending horizontally in the operating position of the auxiliary track rails, the running gears are rollers engaging the legs and running in the track rails.

* * * * *